US006416707B1

(12) United States Patent
Graf

(10) Patent No.: US 6,416,707 B1
(45) Date of Patent: Jul. 9, 2002

(54) METHOD AND APPARATUS FOR PRODUCING FINE WIRE

(75) Inventor: Ralph A. Graf, Freienbach (CH)

(73) Assignee: Graf + Cie AG, Rapperswil (CH)

( * ) Notice: Subject to any disclaimer, the term of this patent is extended or adjusted under 35 U.S.C. 154(b) by 0 days.

(21) Appl. No.: 09/638,094

(22) Filed: Aug. 11, 2000

(30) Foreign Application Priority Data

Aug. 27, 1999 (DE) ..... 199 40 845

(51) Int. Cl.[7] ..... C21D 9/54

(52) U.S. Cl. ..... 266/103; 266/249

(58) Field of Search ..... 266/249, 103

(56) References Cited

U.S. PATENT DOCUMENTS 4,752,061 A * 6/1988 Dalton et al. ..... 266/103
5,294,095 A * 3/1994 Heath et al. ..... 266/103
5,433,420 A * 7/1995 Reiniche et al. ..... 266/103

* cited by examiner

*Primary Examiner*—Scott Kastler
(74) *Attorney, Agent, or Firm*—Friedrich Kueffner

(57) ABSTRACT

In a method for producing fine wire, a wire blank is transformed by a heat treatment process into a drawable state, the wire blank is drawn to a drawn wire, and, subsequently, the drawn wire is subjected, to a hardening and tempering process in order to obtain predetermined mechanical properties by passing the drawn wire through at least one of a furnace device and a cooling device having previously already been employed for performing the heat treatment process. The furnace device has a furnace chamber, receiving at least one wire portion, with a heat distribution block arranged in the area where the wire portion is received. The heat distribution block is designed to uniformly heat the wire portion. The cooling device has a fluidized chamber containing a flowable material. A fluid introduction arrangement is provided to introduce a fluidizing fluid into the fluidized chamber. A heating arrangement is provided for heating the flowable material, wherein the heating arrangement emits electromagnetic waves into the fluidized chamber.

17 Claims, 2 Drawing Sheets

[°C]

METHOD AND APPARATUS FOR PRODUCING FINE WIRE

BACKGROUND OF THE INVENTION

1. Field of the Invention

The invention relates to a method for producing fine wire, especially card wire, in which an optionally already treated, in particular, drawn, wire blank is transformed into a drawable state by a heat treatment process, is then drawn, and is subsequently hardened and tempered for obtaining predetermined mechanical properties; an apparatus for performing such a method; a furnace devices as well as a cooling device of such an apparatus.

2. Description of the Related Art

Card wires of unalloyed and alloyed steels produced with methods of the aforementioned kind are used, for example, for processing textile fibers in cards. For this purpose, the fine wires obtained by this method are further processed to sawtooth wires and, for example, applied to the card flat. For processing the textile fibers the swift of the card with an arrangement applied thereto is set into rotational motion about the cylinder axis so that the arrangement can pass through the supplied fiber material to clean it, wherein the flat arrangements of the stationary or oppositely driven flats interact with the swift arrangement. In this context, it must be ensured for obtaining a satisfactory processing quality that the card wire for all flats of the card has uniform mechanical properties. Moreover, the mechanical properties of the card wires must be maintained at a constantly high level over the total length of the sawtooth wire strips applied to the flats because local defects of the card wires would result in damage of the all-steel sawtooth wire arrangement formed thereof, and this would require a complete exchange. In the context of modern high-performance cards this is connected with very high costs with respect to the resulting machine downtimes and the material required therefor. On the other hand, the coil-shaped wires applied to the cylindrical swift and the total length of the sawtooth wire strips applied to the flat have a length of several hundred meters in modern high-performance cards. Accordingly, when performing a method for producing card wire it must be ensured that the resulting mechanical properties are constant over the entire length of several hundred meters. In the following a known method will be explained with which fine wires can be produced and which fulfills these requirements:

In this connection, first a so-called wire rod is produced and drawn to the elongation limit. The thus obtained drawn wire, however, has generally not yet a sufficiently minimal cross-sectional surface area in a sectional plane extending perpendicularly to the longitudinal direction. Accordingly, the obtained wire blank resulting from the first drawing process is conventionally subjected to a heat treatment process with which it again obtains a microstructure which makes the wire again processable, i.e., drawable.

During the course of this heat treatment process the wire blank in the known method is initially heated to a temperature in the range of 800 to 1,000° C. in which a microstructure transformation of the steel used as the wire material into the austenitic structure will result. Subsequently, the wire is then quenched to a temperature in the range of 400 to 600° C. and is kept at this temperature for a predetermined duration. When using steel as the material for the fine wire or card wire, this causes a microstructure transformation into the pearlitic structure which is characterized by its excellent cold forming properties. After completion of this transformation, the wire is again cooled to room temperature and subjected to a hardening and tempering process for obtaining the predetermined mechanical properties.

For heating the wire to a temperature of 800 to 1,000° C., conductive and inductive heating methods can be employed. In view of the very high energy costs and capital expenditure for furnaces for performing a conductive or inductive heating, the heating to a temperature of 800 to 1,000° C. is, however, carried out generally in electrically heated or gas-heated furnaces through which the wire blank is guided in respective pipes penetrating the furnaces. Such furnaces have the additional advantage that the temperature of the wire portions guided through the furnace can be better maintained at a constant level than with conductive or inductive wire heating, and this has a positive effect on the uniformness of the austenitic structure that can be obtained with this furnace.

For quenching the wire blank to the required temperature in the range of 400 to 600° C. for the microstructure transformation into the pearlitic structure and for maintaining the wire blank at this temperature, liquid lead is used traditionally. The use of liquid lead, however, is a problem because an oxidation of the wire blank at the interface liquid lead-air cannot be prevented and, furthermore, the wire blank passing through the liquid lead bath also entrains lead. This entrained lead must be removed from the wire and must be disposed of. A complete removal of the lead from the wire blank is however almost impossible. Accordingly, lead that is still remaining on the wire blank has a negative effect on the further drawing process and later on also on the surface quality of the card wire.

With respect to these problems in connection with using liquid lead for quenching and subsequent maintaining of the wire blank at the temperature of 400 to 600° C., it has already been suggested to perform this process in a fluidized bed. In such a fluidized bed flowable material, such as, for example, sand, is fluidized by means of compressed air introduced through a bottom of a corresponding fluidized chamber. When the wire blank passes through the resulting layer of fluidized flowable material, a quick cooling of the wire blank to the temperature of the flowable material results because the latter behaves in the fluidized state approximately like liquid and thus can quickly dissipate heat energy from the wire blank.

However, upon passing through the layer of fluidized flowable material, an undesirable oxide layer is formed on the wire blank which, although it is partially removed because of the abrasive effect of the sand conventionally used as a flowable material, then remains within the fluidized chamber. These so-called scale particles have a negative effect on the quenching behavior so that regular cleaning, respectively, regular exchange of the flowable material is required. Moreover, with this method it is also necessary to chemically remove or etch away oxide particles still remaining on the wire blank, the so-called residual scale.

The problems explained supra in connection with the use of fluidized beds occur in even greater form when the flowable material is heated to a temperature in the range of 400 to 600° C. for ensuring the desired microstructure transformation into the pearlitic structure because at these temperatures the formation of the oxide layer is favored and, additionally, combustion products of the conventionally employed gas burners for heating the flowable material will deposit on the wire blank.

For removing the foreign material remaining on the wire blank from the use of the lead bath as well as from the use of a fluidized bed, i.e., also the oxide layer referred to as scale layer, and the additional lead residues, depending on the employed method, a so-called etching device is conventionally used. Conventionally, it is comprised substantially of etching tanks, filled generally with hydrochloric acid or sulfuric acid, and several rinsing tanks through which the wire blank passes sequentially in a cascade-like manner as well as a drying device arranged downstream thereof.

The wire which has thus been returned to a processable, i.e., drawable, state is then drawn in a conventional drawing method in order to obtain the desired wire shape. Subsequently, the card wires must still be hardened and tempered for obtaining the required mechanical properties.

The hardening and tempering process is employed, in particular, in order to obtain for the already drawn wires a strength as high as possible while simultaneously obtaining good tenacity and extension values. For this purpose, a continuous hardening and tempering device is conventionally used in which the drawing wire is first heated to a temperature between 800 and 1,000° C. for obtaining the austenitic structure, is then quenched for obtaining a martensitic transformation, subsequently is heated to a temperature in the range of 400 to 600° C. for forming precipitation from the martensitic microstructure, and then finally is cooled to a temperature of less than 60° C. In this context, for heating the drawn wire to 800 to 1,000° C. an indirect heating method is used that conventionally employs electrically heated or gas-heated furnaces in which the wires are guided in pipes and are generally flushed with an inert gas such as nitrogen for avoiding oxidation. In this first step of the hardening and tempering process special care must be taken that the predetermined wire temperature is exactly observed over the entire furnace length because only in this way the required uniform mechanical properties can be ensured over the entire wire length.

The goal of the quenching step is a martensitic transformation of the microstructure as completely. as possible. For this purpose, oil is generally employed as a quenching medium. For ensuring the desired mechanical properties of the card wires the formation of an oxide layer or a scaling of the wire must be avoided at all cost. For this reason, the quenching zone of the known hardening and tempering devices is connected in an airtight manner to the austenitization furnace. It has already been attempted to employ other quenching media than oil or to use also indirect quenching processes with gas or water. However, in doing so, no satisfactory results with respect to uniformness and fineness of the martensitic structure could be obtained.

As already explained supra, the heating of the wire to a temperature in the range of 400 to 600° C. in the next step of the hardening and tempering method serves to cause precipitation from the martensitic microstructure that has been obtained in the quenching process. This process is also referred to as annealing, and the required furnace device is referred to as an annealing furnace. After completed transformation, the microstructure is comprised of a ferritic base matrix and precipitation embedded therein. This heating can also be performed indirectly in electrically heated or gas-heated furnaces. In this context, the wires are also guided, as in the previously described heating process to temperatures of 800 to 1,000° C., in pipes which are also flushed with an inert gas, in general, nitrogen, for preventing oxidation. In this hardening and tempering step it is also necessary to ensure an excellent temperature consistency in order to obtain uniform mechanical properties over the entire wire length.

The subsequent cooling of the wire to a temperature of 60° C. or less is carried out conventionally indirectly in pipes having water flowing about them.

As can be taken from the above explanation of known methods of the aforementioned kind, these methods require a very high apparatus expenditure and, moreover, are connected with the generation of a plurality of environmentally harmful substances, such as, for example, liquid lead, the sand containing scale particles, the acid used in the etching device, and the oil used for the quenching during the hardening and tempering process.

SUMMARY OF THE INVENTION

It is an object of the present invention to provide a further development of the above explained method according to the prior art with which, while ensuring uniform mechanical properties of the card wire obtained therewith, the capital expenditure for the apparatus used for performing this method can be lowered and at the same time the quantity of environmentally harmful substances resulting from performing this method can be reduced; as well as an apparatus for performing this method; a furnace device and a cooling device for this apparatus.

In accordance with the present invention, this is achieved with respect to the method in a further development of the known method for producing fine wire, especially card wire, which is substantially characterized in that the drawn wire for hardening and tempering passes through at least one furnace device and/or cooling device already used for performing the heat treatment process.

This further development is based on the very simple recognition that the wire in the heat treatment process for obtaining the drawable microstructure is subjected to a temperature profile which is very similar to that of the subsequently performed hardening and tempering process and that an adaptation to the differences of the temperature profiles and to other method-specific conditions can be realized by a corresponding adjustment of the furnace device and/or cooling device used for both processes, i.e., for the heat treatment process as well as for the hardening and tempering process. In the context of this invention it was recognized in particular that, with the corresponding adjustments of the doubly employed apparatus components, the apparatus downtimes incur such minimal costs that with the savings for at least one of the apparatus components overall a more cost-efficient manufacturing process can be obtained. Moreover, by saving at least one apparatus component the space requirements of the apparatus are substantially reduced in comparison to conventional apparatus, and this also contributes to further cost savings. Finally, by the double use of at least one of the apparatus components the quantity of environmentally harmful substances generated by performing the method according to the invention can be significantly reduced. This effect is especially pronounced when at least one cooling device is employed for the heat treatment process as well as for the hardening and tempering process.

As has been already explained above in connection with the known methods, it was found to be especially favorable for obtaining a drawable microstructure of the wire blank when during the course of the heat treatment process it is first heated to a first temperature of preferably approximately 800 to 1,000° C. in a first furnace device, is then cooled by a first cooling device to a second temperature, preferably between the first temperature and room temperature and especially preferred of approximately 400 to 600° C., is optionally kept for a predetermined duration at this second temperature, and is subsequently cooled with a second cooling device approximately to room temperature or a temperature slightly above room temperature. In this context, the wire cooled to the second temperature of preferably approximately 400 to 600° C. can also be kept at this temperature with the corresponding cooling device for a predetermined time. In connection with the desired double use of individual apparatus components for the heat treatment process as well as for the hardening and tempering process, it was however found to be especially favorable when the wire, after exiting the first cooling device, is maintained with a second furnace device at a second temperature. Then it is possible to use the first cooling device for cooling the wire to the second temperature as well as for cooling the wire during the course of the hardening and tempering process because the further heating of the wire blank required during the course of the hardening and tempering process can also be additionally achieved with the second furnace device.

The inventive method can be used already with advantage when only one of the apparatus components required for performing the heat treatment process, i.e., the first furnace device, the first cooling device, the second furnace device, or the second cooling device, is also used for the hardening and tempering process. An especially great savings of capital expenditure for the apparatus to be used for performing the method according to the invention is however achieved when the wire for hardening and tempering passes through the first furnace device as well as the first cooling device as well as the second furnace device as well as the second cooling device.

In this context, it should be mentioned also that the embodiment of this especially preferred method does not allow for a continuous manufacture of card wires because between the heat treatment process and the hardening and tempering process first an adjustment of the individual apparatus components must take place. However, this disadvantage is acceptable especially for manufacturing card wires because the quantity of the required card wire is conventionally substantially below the maximum production capacities of the corresponding apparatus so that for a demand-based production of card wires a machine standstill occurs anyway which can then be used for readjusting the individual apparatus components. Accordingly, when performing the particularly preferred method according to the present invention no additional costs by additional apparatus downtimes are incurred.

As has been explained already in connection with the method according to the prior art, it was found to be especially favorable when the wire for hardening and tempering is first heated to a temperature of approximately 800 to 1,000° C. and subsequently is quenched to approximately room temperature. For this purpose, the first furnace device used during the heat treatment process for heating the wire blank to 800 to 1,000° C. and the first cooling device to be adjusted correspondingly can be employed. In a further hardening and tempering stage the wire is conventionally heated to a fourth predetermined temperature of approximately 400 to 600° C. and is subsequently cooled to room temperature or a temperature slightly above room temperature of less than 100° C., preferably approximately 60° C. For this purpose, the second furnace device and the second cooling device can be used without any special adjustments.

As has been explained already in connection with the method according to the prior art, it is particularly important especially when performing the hardening and tempering process that the temperature in the corresponding furnace devices is constant over the entire length of the wire portion received in the furnace. For this purpose, it was found to be especially favorable when the wire in the first and/or second furnace device passes through a heat distribution block, for example, of a parallelepipedal shape, that is penetrated by corresponding channels and optionally passage pipes arranged therein. Such a heat distribution block can be constructed of a substantially higher mass as the conventionally employed pipes and has therefore excellent heat storage properties with which temperature fluctuations in the furnace device can be buffered so that they no longer have an effect on the wire temperature or the wire temperature course within the furnace. Moreover, the use of a heat distribution block, through which the wire passes, makes it possible to employ gas burner-heated furnaces with very small furnace chambers while ensuring a constant temperature distribution, because the local temperature peaks usually caused by the gas burners can be distributed uniformly even within a small furnace chamber by the relatively high mass of the heat distribution block and can no longer reach the wires passing through the heat distribution block.

As can be taken from the above explanation of an especially preferred embodiment of the method according to the invention, a furnace device according to the invention for performing this method with at least one furnace chamber for receiving at least one wire portion is characterized essentially in that in the furnace chamber in the area of the wire to be arranged therein a heat distribution block is arranged for uniform heating of the wire portion received in the furnace chamber. In this context, the furnace chamber expediently comprises at least one wire inlet and at least one wire outlet separated therefrom and can thus be operated in continuous operation.

For obtaining a uniform heating of the wire portion received in the furnace chamber it is furthermore preferred when the heat distribution block is penetrated by at least one channel receiving the wire portion or a pipe surrounding the wire portion with a snug fit. In an especially preferred embodiment of the invention the furnace device according to the invention is designed to heat simultaneously a plurality of wire portions, wherein the heat distribution block is penetrated by a plurality of parallel extending channels each receiving a wire portion. In this context, the heating of the wire portions passing through the heat distribution block can be realized by heating the heat distribution block from the exterior, preferably by at least one gas burner penetrating one of the walls delimiting the furnace chamber. When using such a furnace device, the scaling of the wire portion to be heated in the furnace chamber and the deposition of combustion products on the wire surface can be prevented when at least one of the channels for receiving a wire portion is sealed off in a gas-tight manner relative to the heated surroundings of the heat distribution block in the heating chamber and is preferably flushed with an inert gas such as nitrogen.

It was found to be especially favorable when the heat distribution block is comprised at least partially of a semiconductor material because such material has a good heat capacity in the relevant temperature range of 400 to 1,000° C. and satisfactory heat conducting properties and, at the same time, has a minimal weight. In this context, it was found to be especially expedient when silicon carbide is used as the semiconductor material because it has especially good thermal properties while having an especially minimal weight.

As explained already beforehand in connection with the known wire manufacturing process, the first and/or the second cooling device can be a fluidized chamber with at least one layer of fluidized flowable material, such as, for example, sand, through which the wire passes for cooling. For preventing the formation of a scale layer on the wire passing through the fluidized chamber, it was found to be especially favorable when the flowable material is fluidized with an inert gas introduced into the fluidized chamber such as, for example, nitrogen or a noble gas or the like. In the last described method, the operational costs incurred in connection with performing the method according to the invention can be kept especially low when the inert gas introduced into the fluidized chamber is returned after removal from the fluidized chamber to be reintroduced.

Moreover, the use of the inert gas for fluidizing the flowable material in the fluidized chamber also results in a considerable reduction of the amount of the substances harmful to the environment, which would otherwise be formed during the wire production, because the generation of scale particles is prevented which otherwise would require a frequent exchange of the flowable material. Also, the use of an inert gas for fluidizing the flowable material in the fluidized chamber also opens up the possibility to completely eliminate the etching device, which is otherwise required for processing the wire transformed by heat treatment into the drawable state, because during the course of cooling of the wire to the second temperature no oxide layer is formed on the wire surface. Accordingly, a further reduction of the environmentally harmful substances which result when performing the method according to the invention is achieved because the acids, which are present in the etching device of conventional methods, are no longer needed. Moreover, the fluidized chamber, when using an inert gas for fluidizing the flowable material, can also be used for quenching during the course of the hardening and tempering process because in this way the scaling of the wire, which for quality considerations must be prevented at any cost during the course of the hardening and tempering process, is reliably prevented. In this manner a further reduction of the amount of the environmentally harmful substances resulting when performing the method according to the invention is achieved because the oil otherwise required for quenching the wire during the hardening and tempering process is no longer needed.

In an especially preferred embodiment of the invention, one and the same fluidized chamber is used during the heat treatment process for obtaining the drawable microstructure as well as during the hardening and tempering process. In this context it is expedient when the flowable material, when using the fluidized chamber for cooling the flowable material during the course of the heat treatment process, is heated to the second predetermined temperature which is conventionally approximately 400 to 600° C. Even though this heating, as in the prior art, can be performed with the aid of a gas burner directly heating the flowable material as well as the gas which is required for fluidizing it, it was found to be especially favorable when electromagnetic waves are radiated into the fluidized chamber for heating the flowable material because in this way the deposition of combustion products, resulting from the use of the gas burner, on the wire surfaces is prevented so that the use of an etching device for processing the wire, which has been transformed into a drawable state by the heat treatment process, can be completely eliminated.

In this context, the electromagnetic waves can be, for example, in the form of heat radiation of a heating tube arranged in the fluidized chamber and preferably penetrating it. This embodiment of the invention has the advantage that, in addition to the heating by the electromagnetic waves emitted by the heating tube, heating of the flowable material by a direct contact with the heating tube can also take place when the heating tube is arranged in the area of the layer of the fluidized flowable material. The heating tube can be, for example, electrically heated. For obtaining an especially high degree of efficiency, however, it was found to be especially favorable when the heating tube is a hollow tube and is heated from the interior by a gas burner wherein the pipe interior is separated in a gas-tight manner relative to the rest of the fluidized chamber.

Additionally or alternatively, the flowable material can also be heated by electromagnetic waves in the form of microwaves radiated into the heating chamber. In this context, an element, such as a klystron, of the corresponding microwave radiation device used for generating the microwaves, can be arranged in the area of a wall delimiting the fluidized chamber, and in this way an additional heating of the flowable material by the waste heat resulting from generating the microwaves can be achieved. This heat exchange realizes at the same time a cooling of the microwave generating element.

Overall, by using two furnace devices according to the invention with a cooling device according to the invention arranged therebetween, an apparatus for performing the inventive method can be provided, and its use for performing the heat treatment process and the hardening and tempering process does not require the use of substances harmful to the environment or produce such substances. In this context, when performing the heat treatment method as well as when performing the hardening and tempering process, a conventional second cooling device for cooling the wire exiting from the second furnace device can be used in which the wire is guided in pipes about which water flows for indirect cooling.

DESCRIPTION OF THE PREFERRED EMBODIMENTS

Figure 1A:
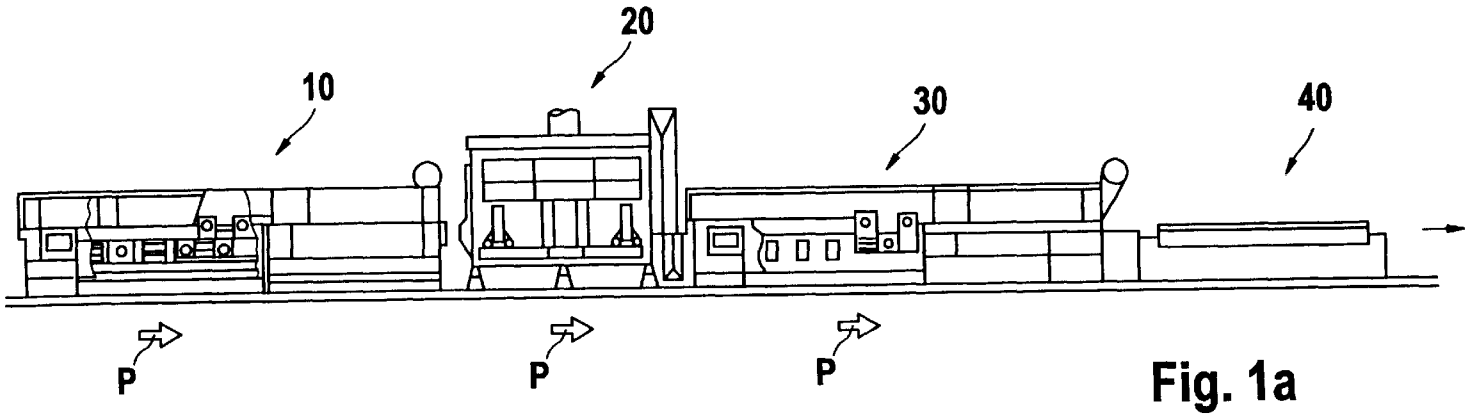
FIG. 1*a* is a schematic representation of the apparatus according to the invention for performing the method according to the invention.
Figure 1B:
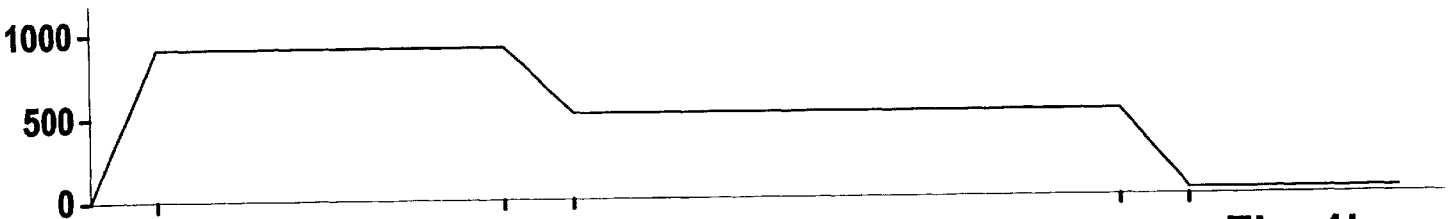
FIG. 1*b* shows a temperature profile for performing the heat treatment process.

In FIG. 1*a* an apparatus according to the invention operable in a continuous mode is schematically represented. This apparatus is comprised substantially of a first furnace device 10, a first cooling device 20, a second furnace device 30, and a second cooling device 40 which are used in this sequence, in the direction of passage indicated by the arrow P, when performing the heat treatment process for obtaining the drawable microstructure as well as the hardening and tempering process for obtaining the desired mechanical properties, i.e., high-strength and at the same time good tenacity and extension values. The temperature profile to which the wires are subjected during the heat treatment process is represented in FIG. 1*b*). Accordingly, the wires are first heated with the first furnace device 10 to a temperature of approximately 900° C., then are cooled with the first cooling device 20 to a temperature of approximately 500° C., and with the second furnace device 30 are kept at this temperature, and subsequently are cooled with the second cooling device 40 to room temperature.

Figure 1C:
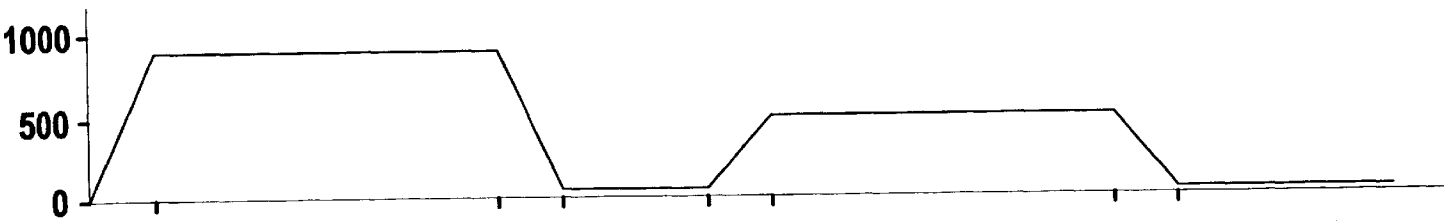
FIG. 1*c* shows a temperature profile for performing the hardening and tempering process.

The temperature profile to which the wires are subjected when using the same device for performing the hardening and tempering process is represented in FIG. 1*c*.

Accordingly, the wires during the hardening and tempering process are first heated with the first furnace device 10 to approximately 900° C., then are cooled with the first cooling device 20 to room temperature, are subsequently heated with the second furnace device 30 to a temperature of approximately 500° C., and are subsequently cooled with the second cooling device 40 again to room temperature or a temperature, slightly above room temperature, of approximately 60° C.

As can be seen in the representation of the temperature profiles of FIGS. 1*b* and 1*c*, the apparatus represented in FIG. 1*a* must be adjusted between the hardening and tempering process by adjusting the first cooling device 20 to the respective temperature profile.

Figure 2:
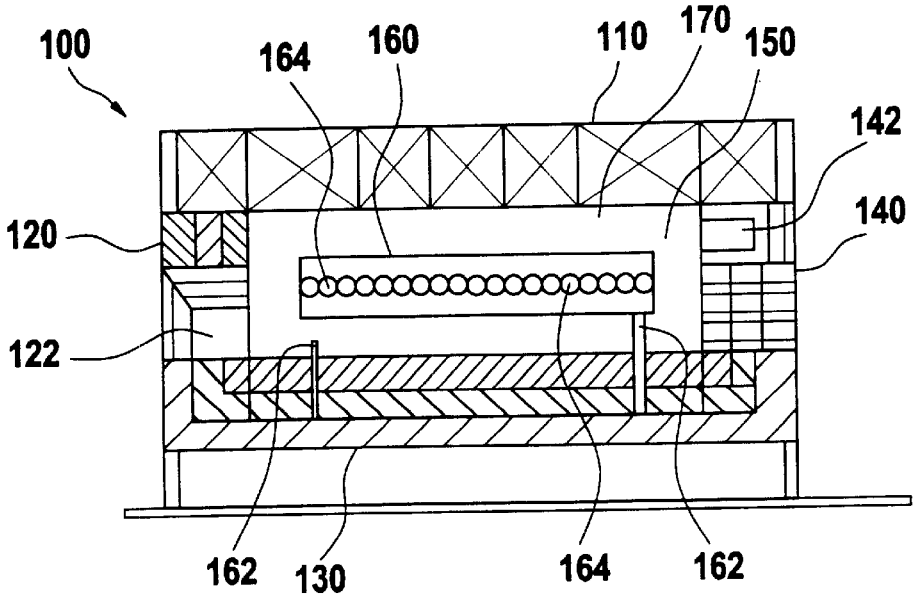
FIG. 2 a schematic sectional representation of one of the furnace devices of the apparatus illustrated in FIG. 1*a*.

In FIG. 2 a furnace 100 is illustrated which can be used for realizing the first furnace device 10 as well as for realizing the second furnace device 30. This furnace 100 comprises a furnace chamber 150 delimited by heat-insulating furnace walls 110, 120, 130, 140, and a heat distribution block 160 manufactured of silicon carbide is arranged therein. This heat distribution block 160 is substantially parallelepipedal and rests at a spacing from the bottom 130 on support elements 162 so that it is surrounded by an outer annular area 170 of the furnace chamber 150. The parallelepipedal silicon carbide block 160 has a plurality of channels 160 penetrating it in the direction of passage indicated with arrow P in FIG. 1 wherein each channel is designed for receiving a wire portion. The wire portions, which are thus received in the heat distribution block 160, and thus also within the furnace chamber 150, respectively, which are passing through the heat distribution block, are indirectly heated by the heat distribution block 160. For this purpose, gas burners are inserted into recesses 142 penetrating the sidewalls 120 and 140. This avoids a direct contact of the combustion products with the wires passing through the channels 164 of the heat distribution block 160 because the annular outer chamber 170 of the furnace chamber 150 is gas-tightly separated from the channels 164 penetrating the distribution block 160.

Figure 3:
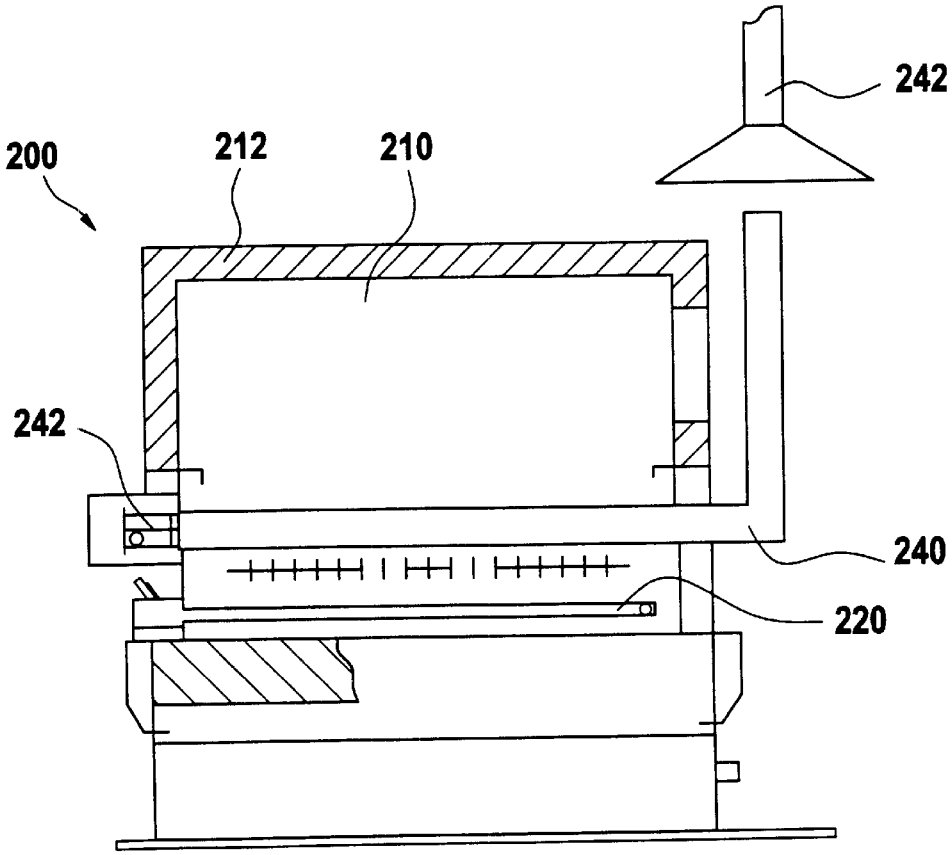
FIG. 3 a schematic sectional view of one of the cooling devices of the apparatus illustrated in FIG. 1*a*.

In FIG. 3 a cooling device in the form of a fluidized bed 200 is represented which can be used for realizing the first cooling device 20 to be used in the apparatus according to the invention illustrated in FIG. 1*a*. This fluidized bed 200 comprises a fluidized chamber 210 delimited by a heat-insulating wall 212 and through which the wires pass in the direction of arrow P in FIG. 1*a*. In the bottom area of the fluidized chamber 210 an arrangement for the introduction of an inert gas into the fluidized chamber is arranged. With the thus introduced inert gas a flowable material contained in the fluidized chamber, for example, sand, can be fluidized so that a liquid-like fluidized layer is formed through which the wires to be cooled are guided. The inert gas, such as, for example, nitrogen, a noble gas or the like, thus introduced into the fluidized chamber 210 is removed from the fluidized chamber 210 and is returned to the introduction arrangement 220.

Above the introduction arrangement 220 the fluidized chamber 210 is penetrated by a heating tube 240 extending perpendicularly to the direction of passage of the wires. This heating tube 240 is formed as a hollow tube and encloses in its interior a gas burner 242, wherein the interior of the heating tube 240 is gas-tightly separated from the rest of the fluidized chamber 210. In this way it is possible that the fluidized sand in the fluidized chamber 210, fluidized by means of the inert gas introduced via the introduction arrangement 220, can be heated during the heat treatment process to a predetermined temperature of approximately 500° C., without the inert gas atmosphere within the fluidized chamber 210 being contaminated by combustion products while it is ensured at the same time that the wires passing through the fluidized chamber 210 are not oxidized because the fluidization is carried out with the inert gas. The exhaust gases of the gas burner are removed by a suction device 244 and guided away.

The invention is not limited to the embodiment explained with the aid of the drawing. Instead, the flowable material in the fluidized chamber 210 can also be heated by irradiating it with microwaves, wherein a corresponding microwave generating element, such as, for example, a klystron, is arranged in the area of a sidewall of the fluidized chamber 210 in order to thus contribute also to the heating of the flowable material and, on the other hand, to be cooled by the flowable material. Moreover, it is conceivable to adjust the apparatus according to the invention such that temperature profiles deviating from the temperature profiles illustrated in FIG. 1 are being used, for example, in the case of high-alloyed steels used as material for the wires to be produced. Finally, the furnace devices 10 and 30 of the apparatus illustrated in FIG. 1 can also be dimensioned differently.

While specific embodiments of the invention have been shown and described in detail to illustrate the inventive principles, it will be understood that the invention may be embodied otherwise without departing from such principles.

What is claimed is:

1. An apparatus for performing a method for producing fine wire including the steps of:

transforming a wire blank by a heat treatment process into a drawable state;

drawing the wire blank to a drawn wire; and subsequently subjecting the drawn wire to a hardening and tempering process in order to obtain predetermined mechanical properties by passing the drawn wire through at least one of a furnace device and a cooling device having previously already been employed for performing the heat treatment process;

the apparatus comprising at least one furnace device with at least one heatable furnace chamber configured to receive at least one wire portion of the wire blank or the drawn wire, wherein the furnace chamber comprises a heat distribution block arranged in the area where the wire portion is to be received, wherein the heat distribution block is configured to uniformly heat the wire portion; and a cooling device comprising:

a fluidized chamber containing a flowable material;

a fluid introduction arrangement configured to introduce a fluidizing fluid into the fluidized chamber; and a heating arrangement configured to heat the flowable material, wherein the heating arrangement is configured to emit electromagnetic waves into the fluidized chamber.

2. The apparatus according to claim 1, wherein the furnace chamber has at least one wire inlet and at least one wire outlet separated from the wire inlet and is configured to be operated in a continuous mode.

3. The apparatus according to claim 1, wherein the heat distribution block has at least one channel penetrating the heat distribution block and configured to receive the wire portion.

4. The apparatus according to claim 3, wherein the heat distribution block has several of the channels extending parallel to one another and each receiving a wire portion.

5. The apparatus according to claim 4, wherein the heat distribution block is configured to be heatable externally.

6. The apparatus according to claim 5, comprising at least one gas burner penetrating a wall delimiting the furnace chamber and configured to heat the heat distribution block.

7. The apparatus according to claim 5, wherein at least one of the channels is gas-tightly separated from heated surroundings of the heat distribution block in the furnace chamber.

8. The apparatus according to claim 1, wherein the heat distribution block is comprised at least partially of a semiconductor material.

9. The apparatus according to claim 8, wherein the semiconductor material is silicon carbide.

10. The apparatus according to claim 1, wherein the flowable material is sand.

11. The apparatus according to claim 1, wherein the heating arrangement comprises at least one heating tube arranged in the fluidized chamber.

12. The apparatus according to claim 11, wherein the heating tube penetrates the fluidized chamber.

13. The apparatus according to claim 11, wherein the heating tube is a hollow tube, wherein an interior of the hollow tube is gas-tightly sealed relative to the fluidized chamber.

14. The apparatus according to claim 13, further comprising a gas burner configured to generate a gas flame in the interior of the hollow tube.

15. The apparatus according to claim 1, wherein the heating arrangement comprises at least one microwave emitting device configured to emit microwaves into the fluidized chamber.

16. The apparatus according to claim 15, wherein an element of the microwave emitting device configured to generate microwaves is arranged in the area of a wall delimiting the fluidized chamber and is configured to additionally heat the flowable material.

17. The apparatus according to claim 1, wherein the fluidized chamber comprises a return arrangement configured to recirculate the fluidizing fluid into the fluidized chamber after the fluidizing fluid has passed through the fluidized chamber.

* * * * *